US012364896B2

(12) United States Patent
Meredith

(10) Patent No.: US 12,364,896 B2
(45) Date of Patent: Jul. 22, 2025

(54) SMITH MACHINE HAVING REVERSIBLE COMPONENTS THAT VARY THE LIFTING ANGLE OF THE MACHINE

(71) Applicant: HOIST FITNESS SYSTEMS, INC., Poway, CA (US)

(72) Inventor: Jeffrey O. Meredith, Del Mar, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 82 days.

(21) Appl. No.: 18/545,282

(22) Filed: Dec. 19, 2023

(65) Prior Publication Data

US 2024/0216743 A1 Jul. 4, 2024

Related U.S. Application Data

(60) Provisional application No. 63/435,719, filed on Dec. 28, 2022.

(51) Int. Cl.
*A63B 21/062* (2006.01)
*A63B 21/072* (2006.01)
*A63B 21/078* (2006.01)

(52) U.S. Cl.
CPC ..... *A63B 21/0626* (2015.10); *A63B 21/0724* (2013.01); *A63B 21/078* (2013.01)

(58) Field of Classification Search
CPC ..... A63B 21/0615; A63B 21/0626; A63B 21/0724; A63B 21/078; A63B 21/0783; A63B 21/4035; A63B 2225/093
See application file for complete search history.

(56) References Cited

U.S. PATENT DOCUMENTS

| | | | | |
|---|---|---|---|---|
| 5,184,992 | A | 2/1993 | Banks | |
| 6,527,683 | B2 | 3/2003 | Tolles | |
| 7,374,516 | B2 | 5/2008 | Lundquist | |
| D590,032 | S * | 4/2009 | Webber | D21/691 |
| 7,713,179 | B2 | 5/2010 | Webber | |
| 8,328,698 | B1 * | 12/2012 | Webber | A63B 21/4043 482/106 |
| 8,444,537 | B1 | 5/2013 | Santoro | |

(Continued)

FOREIGN PATENT DOCUMENTS

| | | |
|---|---|---|
| CN | 217511067 U | 9/2022 |
| KR | 101394856 B1 | 5/2014 |

OTHER PUBLICATIONS

Alpha Smith Machine (0 or 7 Degree), Arsenal Strength Equipment, myarsenalstrength.com website, 2023, 5 pages.

(Continued)

*Primary Examiner* — Joshua Lee
(74) *Attorney, Agent, or Firm* — David R. Heckadon; Gordon Rees Scully Mansukhani LLP

(57) ABSTRACT

A Smith Machine, having a pair of reversible bottom support brackets that can be mounted in a first position such that the upright assembly is in a first upwardly extending orientation or in a second position such that the upright assembly is in a second upwardly extending orientation so as to vary the lifting angle of the Smith Machine, and a pair of upright assemblies providing safety latches that can each be mounted in forward or backward facing orientations such that the user can select the rotation to lock a lift bar in position.

11 Claims, 13 Drawing Sheets

(56) References Cited

U.S. PATENT DOCUMENTS

| | | | | |
|---|---|---|---|---|
| 9,302,139 | B2 | 4/2016 | Habing et al. | |
| 10,245,461 | B2 * | 4/2019 | Bruni | A63B 21/0783 |
| 10,556,144 | B2 | 2/2020 | Habing et al. | |
| 10,646,740 | B2 | 5/2020 | Lee | |
| 11,389,690 | B2 | 7/2022 | Valdez et al. | |
| 11,565,144 | B2 | 1/2023 | Habing et al. | |
| 2002/0091043 | A1 | 7/2002 | Rexach | |
| 2009/0124469 | A1 * | 5/2009 | Webber | A63B 21/0618 482/98 |
| 2009/0143203 | A1 | 6/2009 | Knapp | |
| 2009/0170668 | A1 | 7/2009 | Giannelli et al. | |
| 2010/0022363 | A1 | 1/2010 | Fenster et al. | |
| 2014/0087928 | A1 | 3/2014 | Luedeka | |
| 2016/0213967 | A1 | 7/2016 | Habing et al. | |
| 2017/0266480 | A1 | 9/2017 | Bruni et al. | |
| 2018/0318635 | A1 * | 11/2018 | Lee | A63B 24/0087 |
| 2019/0134452 | A1 * | 5/2019 | Schween | A63B 21/4035 |
| 2019/0217148 | A1 | 7/2019 | Bruni et al. | |
| 2020/0069988 | A1 | 3/2020 | Gore | |
| 2022/0096891 | A1 | 3/2022 | Yang | |
| 2022/0219033 | A1 | 7/2022 | Lee | |

OTHER PUBLICATIONS

United States International Searching Authority, International Search Report and Written Opinion for corresponding International Application No. PCT/US2023/028791, mailed Oct. 24, 2023, 8 pages.

GFS Smith Machine with Linear Bearings with 7° Angle Free-Weight Barbell , Home and Semi-Commercial Gym Workout Center Designed for Upper and Lower Body Exercise, G Fashion Style, Mar. 20, 2022, 8 pages, https://www.amazon.com/Machine-Linear-Bearings_Freeweight-Barbell/dp/B09W11KQ1G?ref_=ast_sto_dp.

United States International Searching Authority, International Search Report and Written Opinion for corresponding International Application No. PCT/US2023/084885, mailed May 17, 2024, 11 pages.

* cited by examiner

SMITH MACHINE HAVING REVERSIBLE COMPONENTS THAT VARY THE LIFTING ANGLE OF THE MACHINE

RELATED APPLICATION

The present invention claims priority to U.S. Provisional Patent Application Ser. No. 63/435,719, of same title, filed Dec. 28, 2022, the entire disclosure of which is incorporated herein by reference in its entirety for all purposes.

TECHNICAL FIELD

The present invention relates to exercise machines commonly known as Smith Machines.

BACKGROUND OF THE INVENTION

Smith Machines are common weight lifting/gym equipment. They act as a safety system for a person lifting a weighted barbell by providing a plurality of vertical racking positions upon which the barbell can be secured. Smith machines are commonly used to perform squats, standing lifts and bench press exercises. Smith machines also stabilize the barbell during lifting and can help to prevent the user from dropping the barbell onto themselves. Smith Machines basically resemble cages that provide defined lifting paths for the weighted barbell. They have a series of vertical notched racking positions onto which the barbell (or barbell latch or lever) can be rested, permitting the user to stop at multiple lifting heights during a lift and place the barbell onto one of the notches as desired. Smith Machines typically have locking mechanisms that permit the user to lock the barbell at a desired vertical height by simply rotating a locking a lever attached to the bar into any one of these vertical notches.

Typically, the lifting path through which the barbell is lifted in a Smith machine is either a straight vertical path (i.e.: 90 degrees to the ground), or a slightly angled vertical path (commonly 83 degrees to the ground). Different people prefer different vertical path angles. Unfortunately, the vertical lift angle is defined by the geometry of the particular Smith Machine that they are using. Simply put, some Smith Machines are built with one vertical lifting angle whereas other Smith Machines are built with a different vertical lifting angle.

It would instead be desirable to provide a single Smith Machine that can be shipped to a customer wherein the machine parts have the ability to be assembled in different configurations such that the user selects their desired lifting angle when they first assemble the machine.

Secondly, some Smith Machine locking mechanisms lock the barbell lever into the racking position in the vertical notches by rotating the top of the barbell forwards. Conversely, other Smith Machines lock the barbell lever into position in the vertical notches by rotating the top of the barbell backwards/rearwards. There is no standardization in the industry. Half of the machines operate one way, and half of them operate the other way.

It would instead be desired to provide a single Smith Machine that can be shipped to a customer wherein the machine parts have the ability to be assembled in different configurations such that the user selects which way to rotate the barbell for it to lock into its resting position(s) when they first assemble the machine.

SUMMARY OF THE INVENTION

In preferred aspects, the present system provides a Smith Machine, comprising:

(a) a pair of upright assemblies;

(b) a pair of support assemblies, wherein each support assembly is connected to one of the pair of upright assemblies;

(c) a pair of reversible bottom support brackets wherein each reversible bottom support bracket connects one of the upright assemblies to one of the support assemblies, and wherein each reversible support bracket can be mounted in a first position such that the upright assembly is in a first upwardly extending orientation or in a second position such that the upright assembly is in a second upwardly extending orientation, and wherein each of the upright assemblies can each be mounted into a forward facing orientation or in a backward facing orientation; and (d) a lift bar spanning between the pair of upright assemblies.

In one preferred aspect, the first upwardly extending orientation is 90 degrees to the floor surface. In another preferred aspect, the second upwardly extending orientation is 83 degrees to the floor surface.

In preferred aspects, the bottom support brackets are generally L-shaped.

In preferred aspects, each upright assembly comprises:

a lever rest mount having a series of lever rest racking positions, a barbell slide pole positioned parallel to and spaced apart from the lever rest mount, a slider on the barbell slide pole, the slider supporting one of the ends of the barbell, and a locking lever dimensioned to be received into any one of the series of lever rest positions on the lever rest mount, wherein rotation of the barbell rotates the locking lever into one of the series of lever rest position, and a counterweight system that provides an upward force on the slider on the barbell slide pole.

Preferably, the counterweight system comprises a pair of pulleys, a weight, and a cable passing over the pair of pulleys (all disposed within the body of the upright assembly). The cable is connected to the weight and to the slider.

One advantage of the present system is that the user can assemble the very same parts to construct a Smith Machine having a first lifting angle (e.g.: 90 degrees) or a second lifting angle (e.g.: 83 degrees). As such, the manufacturer only needs to build and supply the same component parts to all customers, with the customers choosing their preferred lifting angle by the way they first assemble these parts.

A second advantage of the present system is that the user assembles the very same parts to construct a Smith Machine in which the barbell can be locked at a vertical height either by rotating it forwards or rotating it backwards as decided by the user. As such, the manufacturer only needs to build and supply the same component parts to all customers, with the customers choosing their preferred locking rotation by the way they first assemble these parts.

BRIEF DESCRIPTION OF THE DRAWINGS

(FIG. 6A corresponds to the device of FIGS. 1 to 5, and FIG. 6B corresponds to the device of FIG. 9).

DETAILED DESCRIPTION OF THE DRAWINGS

Figure 1:
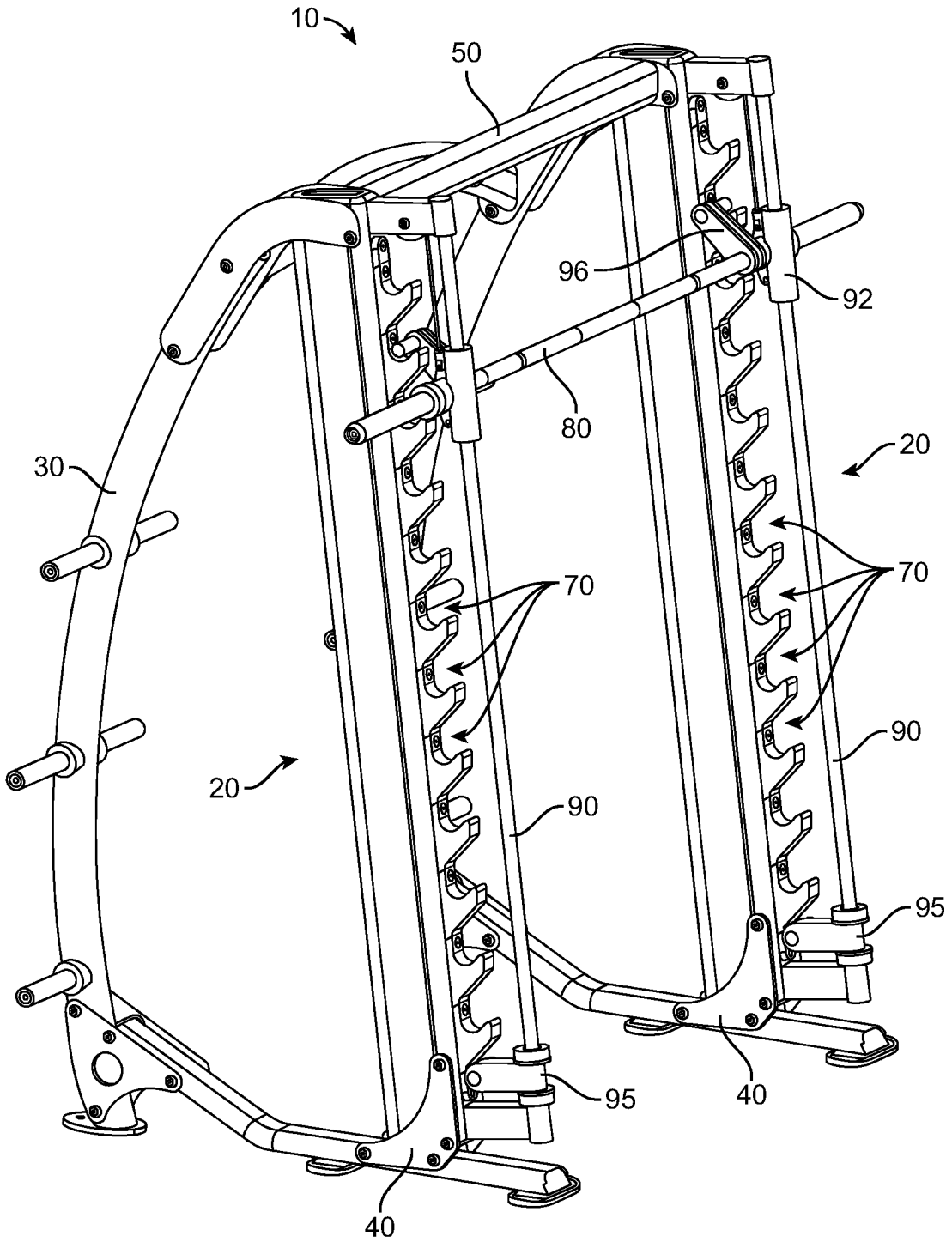
FIG. 1 is a perspective view of a first embodiment of the present Smith Machine system having a lifting angle of 83 degrees and a series of forward facing racking notches.
Figure 2:
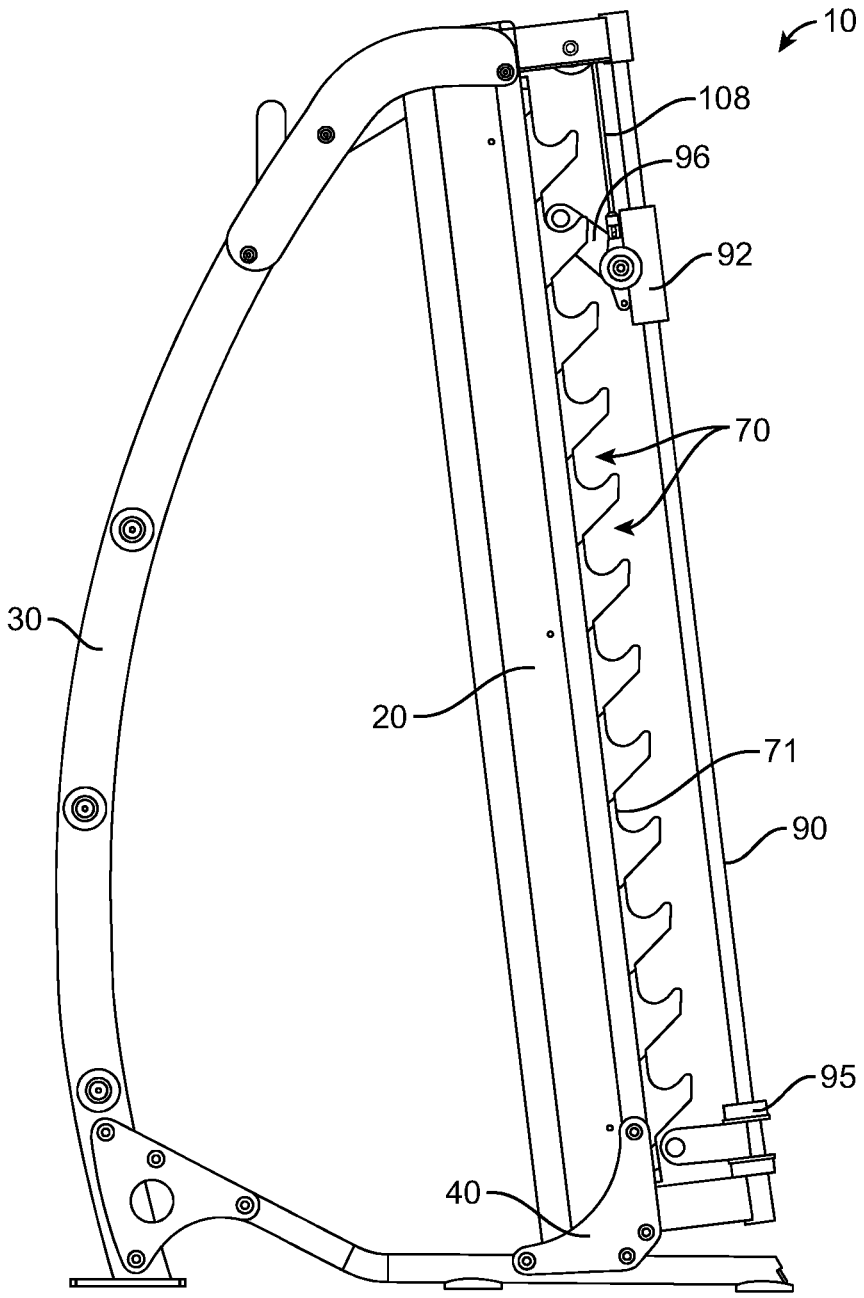
FIG. 2 is a side elevation view of the Smith Machine of FIG. 1.

FIGS. 1 to 6A show a first preferred embodiment of the present Smith Machine system having a lifting angle of 83 degrees and a series of forward facing racking notches, as follows.

The present Smith Machine 10, preferably comprises: a pair of upright assemblies 20 and a pair of support assemblies 30. Each support assembly 30 is connected to one of the pair of upright assemblies 20. In accordance with the present system, a pair of reversible generally L-shaped bottom support brackets 40 are provided and each reversible bottom support bracket 40 connects one of the upright assemblies 20 to one of the support assemblies 30, as shown. Importantly, each reversible support bracket 40 can be mounted in a first position (FIGS. 1 to 6A) such that the upright assembly is in a first upwardly extending orientation or in a second position (FIGS. 6B, 9 and 10) such that the upright assembly is in a second upwardly extending orientation. In preferred aspects, the first upwardly extending orientation is 90 degrees to a floor surface and the second upwardly extending orientation is 83 degrees to a floor surface. In alternate embodiments encompassed by the present system, the second upwardly extending orientation may be from 80 to 85 degrees.

Figure 3:
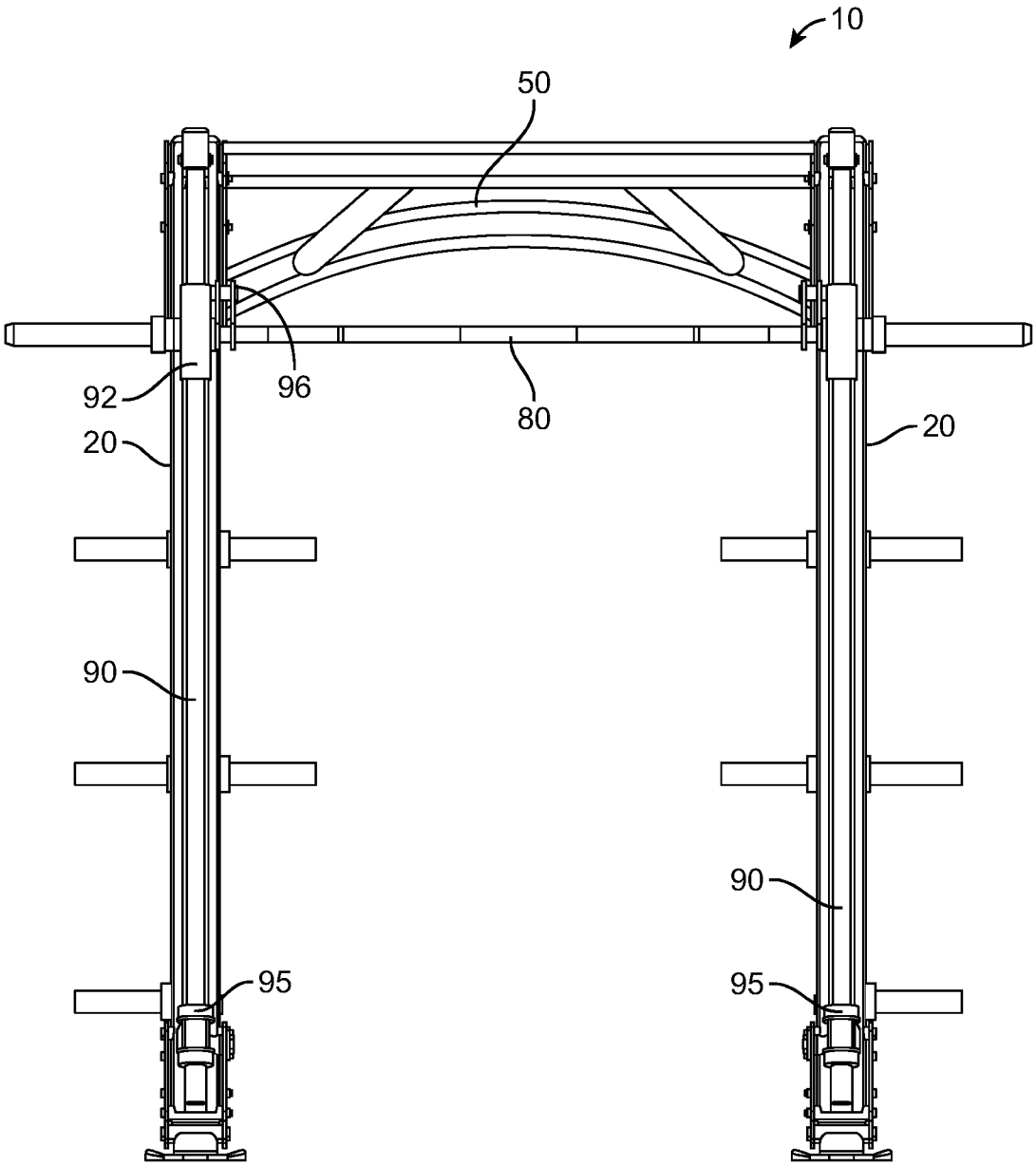
FIG. 3 is a front elevation view of the Smith Machine of FIGS. 1 and 2.
Figure 4:
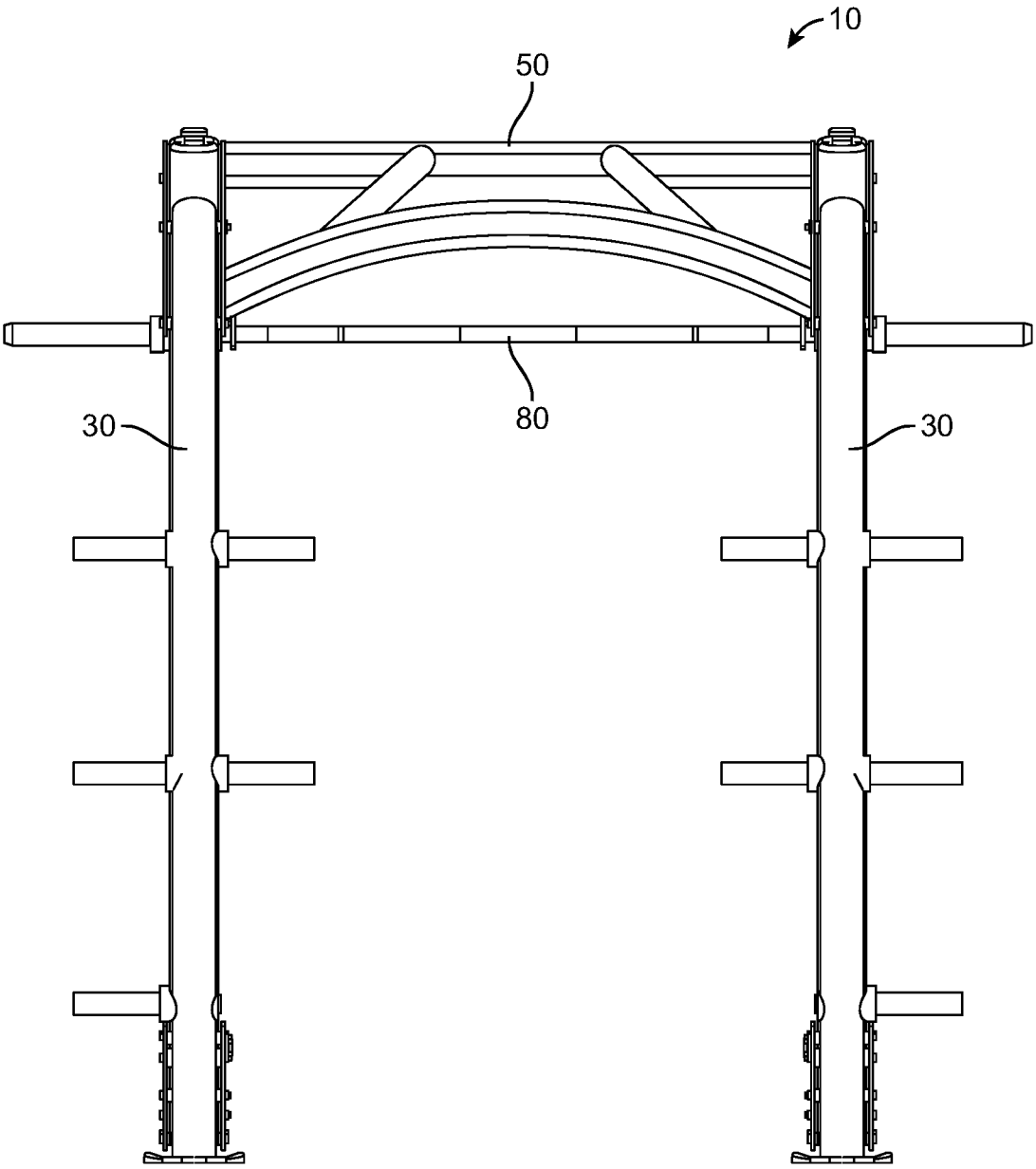
FIG. 4 is a rear elevation view of the Smith Machine of FIGS. 1 to 3.
Figure 5:
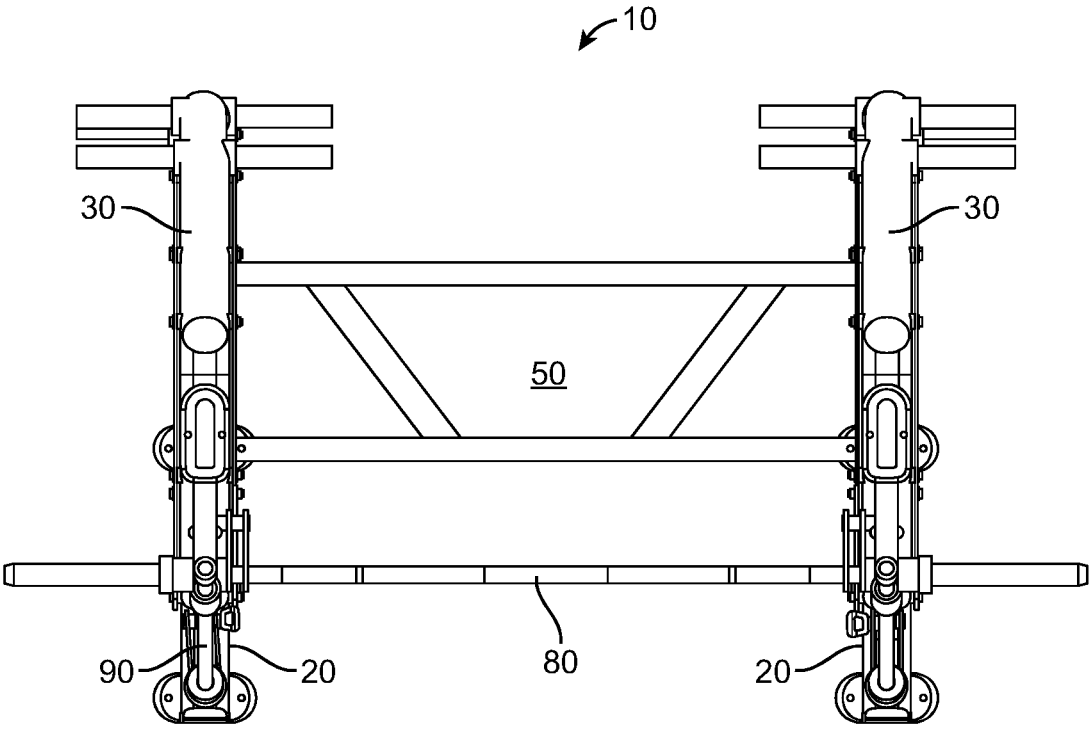
FIG. 5 is a top plan view of the Smith Machine of FIGS. 1 to 4.

As best seen in FIGS. 3, 4 and 5, the present system preferably includes a top assembly 50 for holding the two upright assemblies 20 in vertically extending positions parallel to one another, as shown. The top assembly 50 may connect upper portions of the upright assemblies 20 together, or connect upper portions of the support assemblies 30 together, or even connect upper portions of both the upright assemblies 20 and the support assemblies 30 together, all keeping within the scope of the present system.

Figure 9:
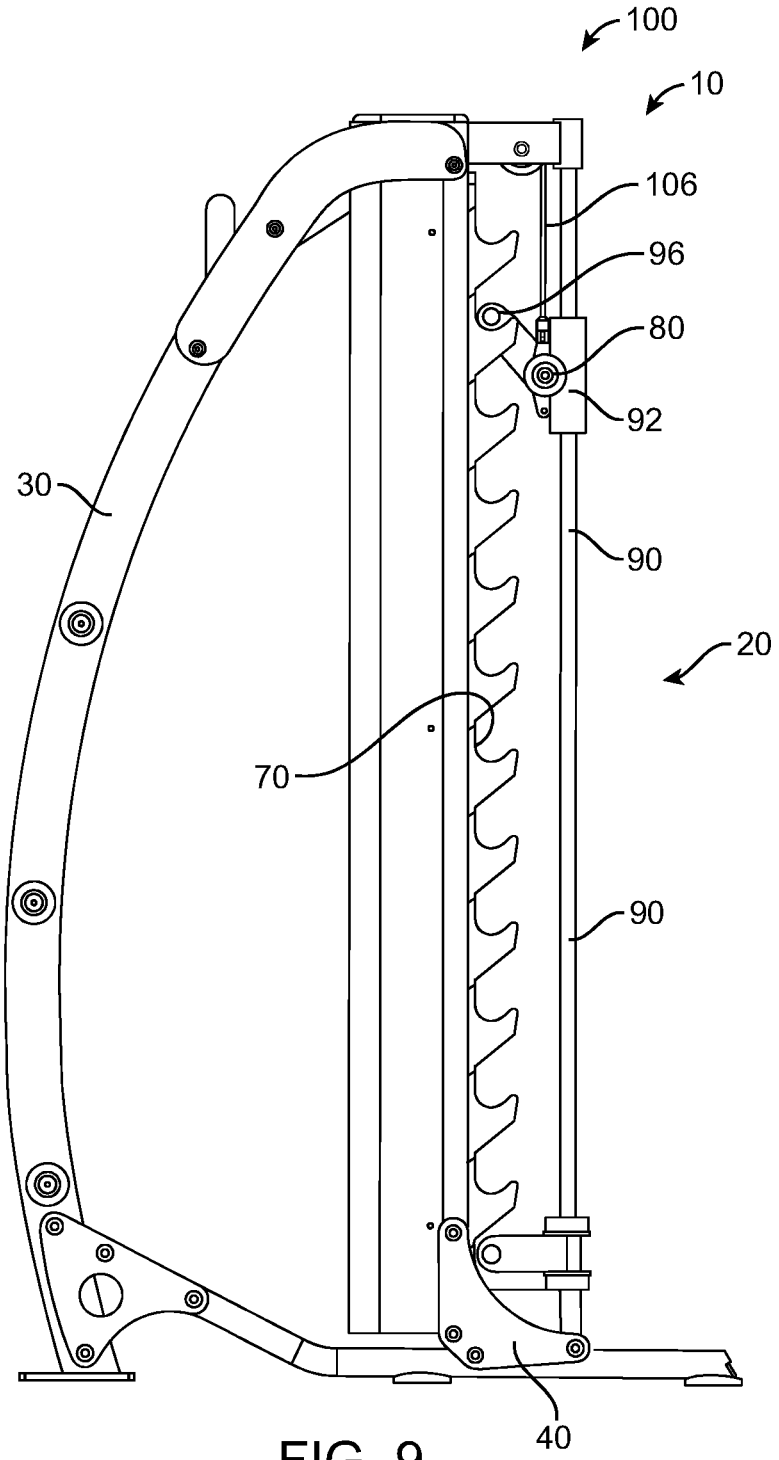
FIG. 9 is a side elevation view of a second embodiment of the present Smith Machine system having a lifting angle of 90 degrees and a series of forward facing racking notches.
Figure 10:
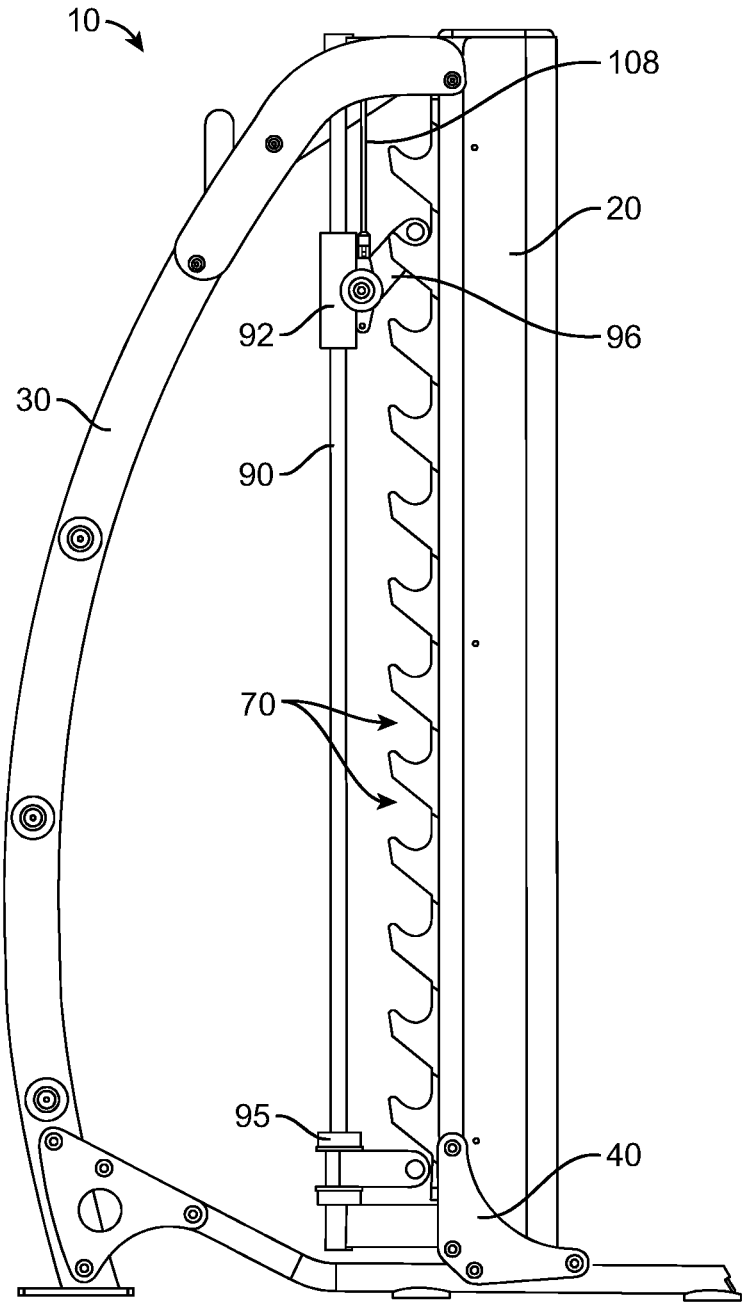
FIG. 10 is a side elevation view of a third embodiment of the present Smith Machine having a lifting angle of 90 degrees and a series of backward facing racking notches.
Figure 11:
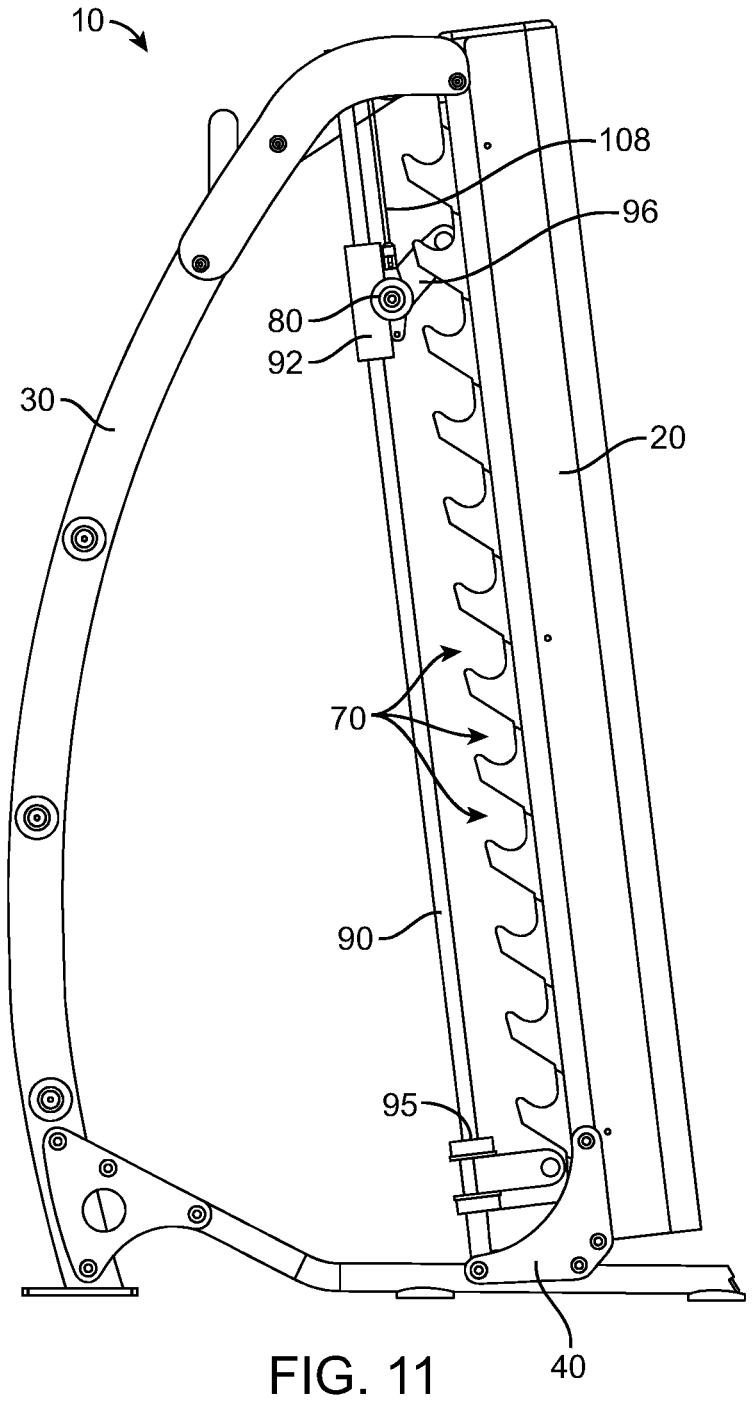
FIG. 11 is a side elevation view of a fourth embodiment of the present Smith Machine having a lifting angle of 83 degrees and a series of backward facing racking notches.

As can also be seen, upright assemblies 20 can each be mounted in a forward facing orientation (FIGS. 1 to 6B, 9, 12A and 12B) or in a backward facing orientation (FIGS. 10 and 11). As defined herein, "forward" facing is when the resting/racking notches 70 face towards the front of the machine (e.g.: FIGS. 1 to 6B, 9, 12A and 12B), whereas "backward" facing is when the resting/racking notches 70 face towards the back of the machine (e.g.: FIGS. 10 and 11). Also provided is a lift bar 80 spanning between the pair of upright assemblies 20.

Figure 6A:
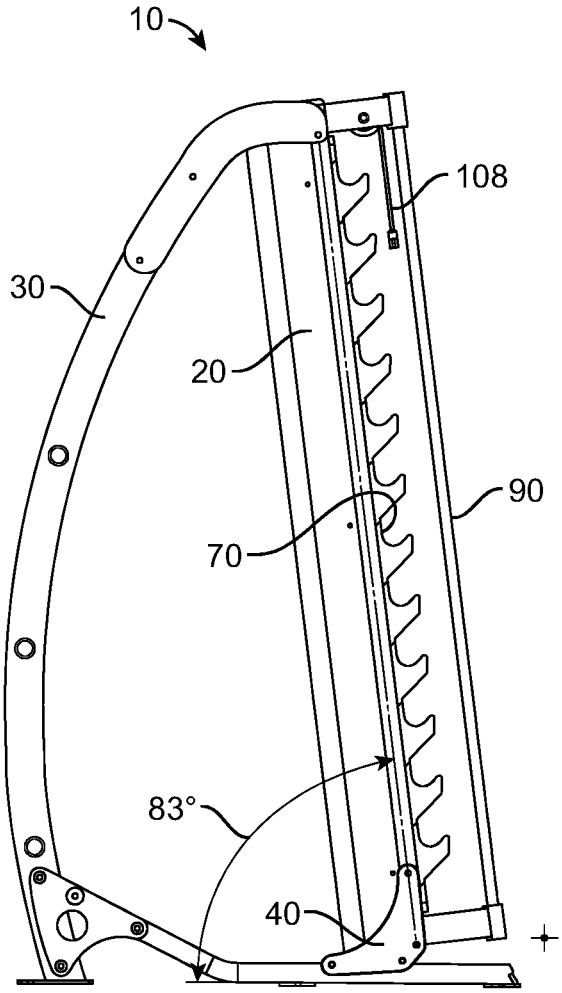
FIGS. 6A and 6B show alternate lifting angles achieved by the placement of the bottom support brackets.
Figure 6B:
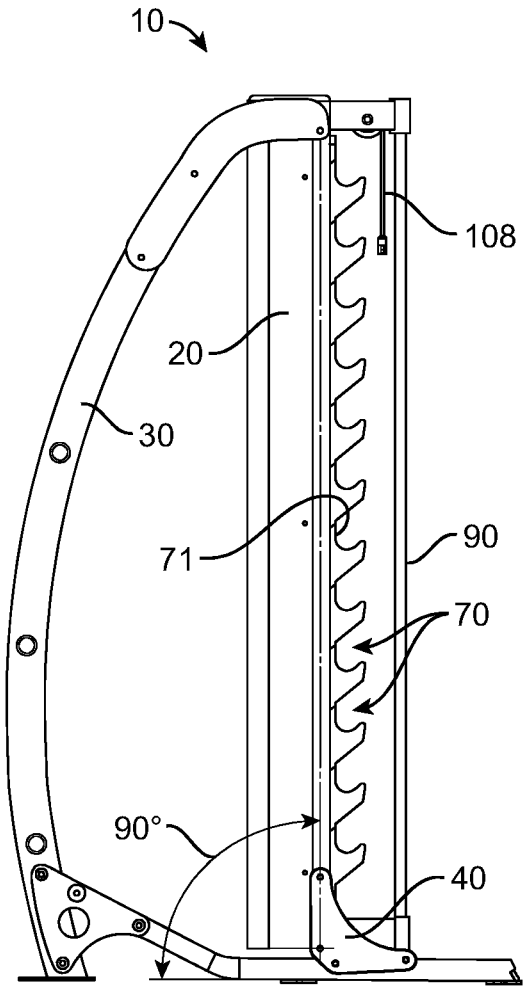

FIGS. 6A and 6B show alternate lifting angles achieved by the placement of the bottom support brackets. (FIG. 6A corresponds to the device of FIGS. 1 to 5, and FIG. 6B corresponds to the device of FIG. 9).

Figure 7:
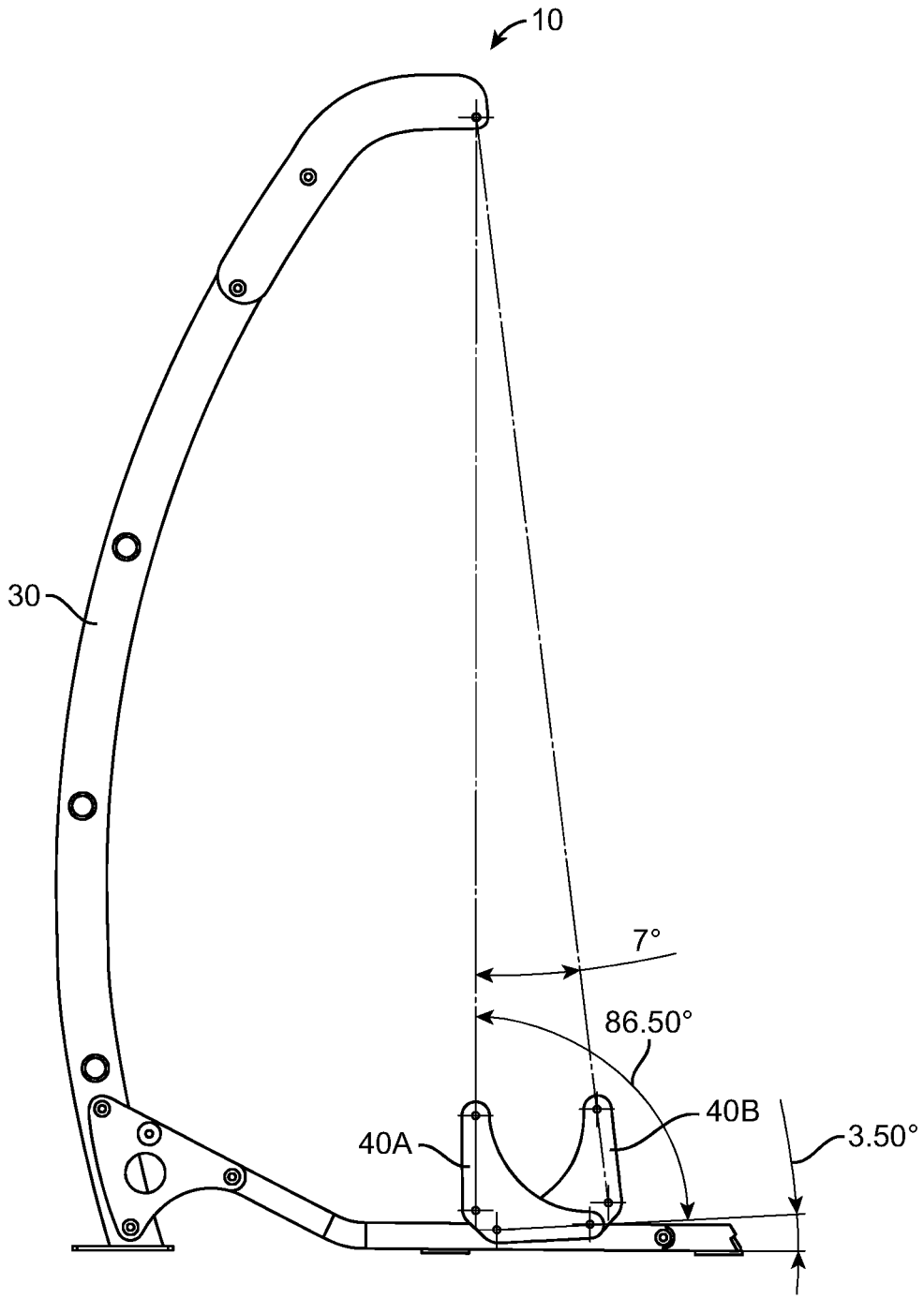
FIG. 7 is a side elevation view of the present system with various components removed showing the different lifting angles achieved by placement of the bottom support brackets.

FIG. 7 is a side elevation view of the present system with various components removed showing the different lifting angles achieved by placement of the bottom support brackets 40. In this example, support bracket 40B is a support bracket 40 mounted in the position of FIGS. 1 to 6B, 9, 11, 12A and 12B such that the lift angle is 90 degrees (86.5+3.5 degrees). Also in this example, support bracket 40A is a support bracket 40 mounted in the position of FIGS. 9 and 10.

Figure 8A:
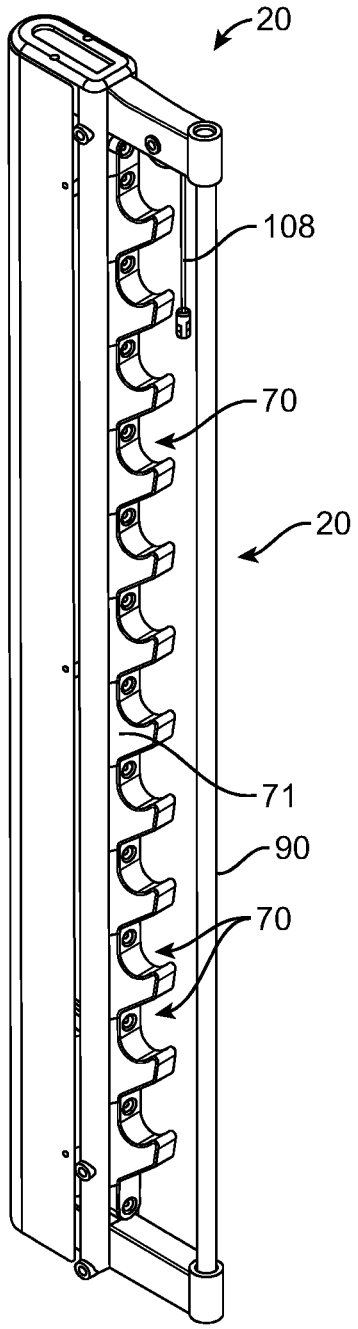
FIG. 8A is a perspective view of one of the upright assemblies.
Figure 8B:
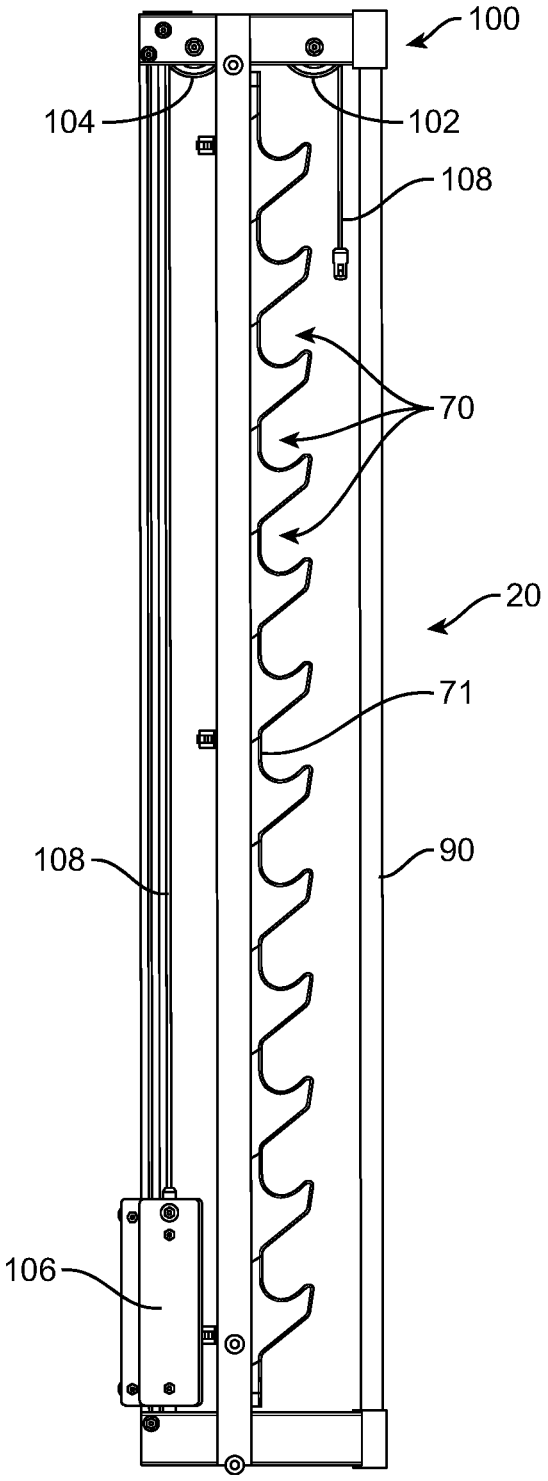
FIG. 8B is a side elevation view corresponding to FIG. 8A, with the outer sides of the assembly removed to show internal components.

FIG. 8A is a perspective view of one of the upright assemblies, and FIG. 8B is a side elevation view corresponding to FIG. 8A, with the outer sides of the assembly removed to show internal components. Preferably, each upright assembly 20 comprises a lever rest mount 71 having a series of lever rest racking positions or notches 70.

A barbell slide pole 90 is positioned parallel to and spaced apart from the lever rest mount 70. A slider 90 preferably runs up and down along barbell slide pole 90 and the slider 90 supports one of the ends of barbell 80. A locking lever 96 is dimensioned to be received into any one of the series of lever rest positions 70 on the lever rest mount 71. Rotation of the barbell 80 rotates the locking lever 94 into one of the series of lever rest positions 70. In operation, therefore, when the user has positioned barbell 80 at a desired height, barbell 80 can simply be rotated such that locking lever 96 rotates into position, holding the barbell 80 at this desired height. A slider stop 95 is also preferably at the bottom of the barbell slide pole 90 for stopping downward motion of the slider 92 at the point when slider 92 rests on top of slider stop 95.

Upright assembly 20 preferably also includes a counterweight system 100 that provides an upward force on the slider on the barbell slider 90. The counterweight system 100 comprises: a pair of pulleys 102 and 104, a weight 106, and a cable 108 passing over the pair of pulleys, the cable 108 being connected both to the weight 106 and to the slider 92. As seen in FIG. 8A, the pulleys 102 and 104, weight 106 and cable 108 can all be disposed within the body of the upright assembly 20. (With cable 108 progressively pulled out of the body of the upright assembly as barbell 80 is lowered).

FIG. 9 is a side elevation view of a second embodiment of the present Smith Machine system having a lifting angle of 90 degrees and a series of forward facing notches 70. FIG. 10 is a side elevation view of a third embodiment of the present Smith Machine having a lifting angle of 90 degrees and a series of backward facing racking notches. The user assembling the present system simply decides if (s)he wants notches 70 forward facing (FIG. 9) or backward facing (FIG. 10) when they assemble the present system. As can be seen upright assemblies 20 may be easily bolted into either position (using the same placement of bottom support brackets 40).

When in the position of FIG. 9, the user rotates the top of barbell 80 in a backward direction to lower lever 96 into notch 70. Conversely, when in the position of FIG. 10, the user rotates the top of barbell 80 in a forward direction to lower lever 96 into notch 70. As such, the user has the advantage of selecting their preferred locking direction of rotation (i.e.: forwards or backwards) when they first assemble the present system.

FIG. 11 is a side elevation view of a fourth embodiment of the present Smith Machine having a lifting angle of 83 degrees and a series of backward facing notches 70. In this embodiment, upward assemblies 20 as installed in the same position as in FIG. 10, but the bottom support bracket 40's position is reversed.

Figure 12A:
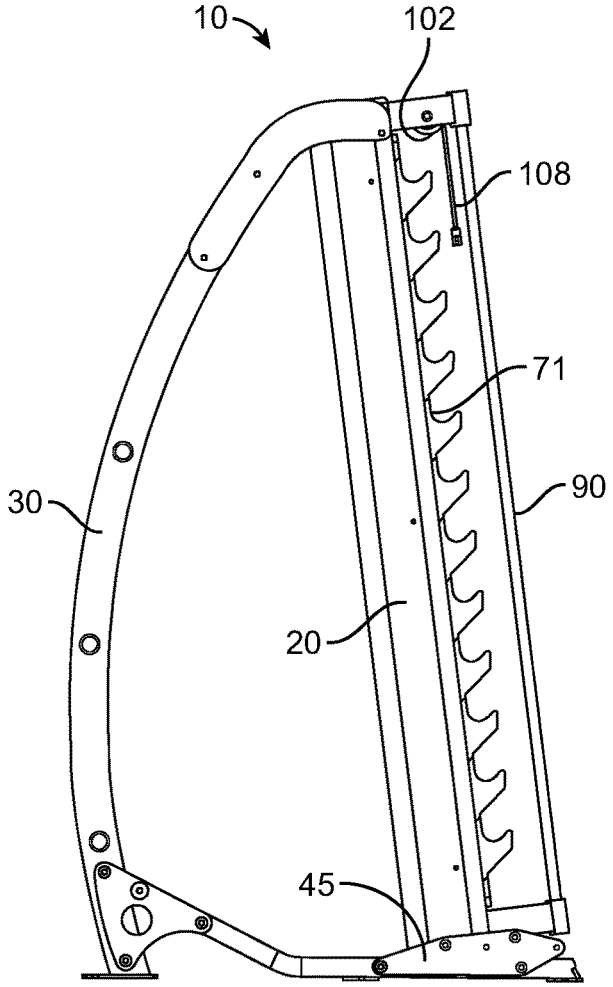
FIGS. 12A and 12B show alternate lifting angles achieved by the placement of a second embodiment of the bottom support brackets.
Figure 12B:
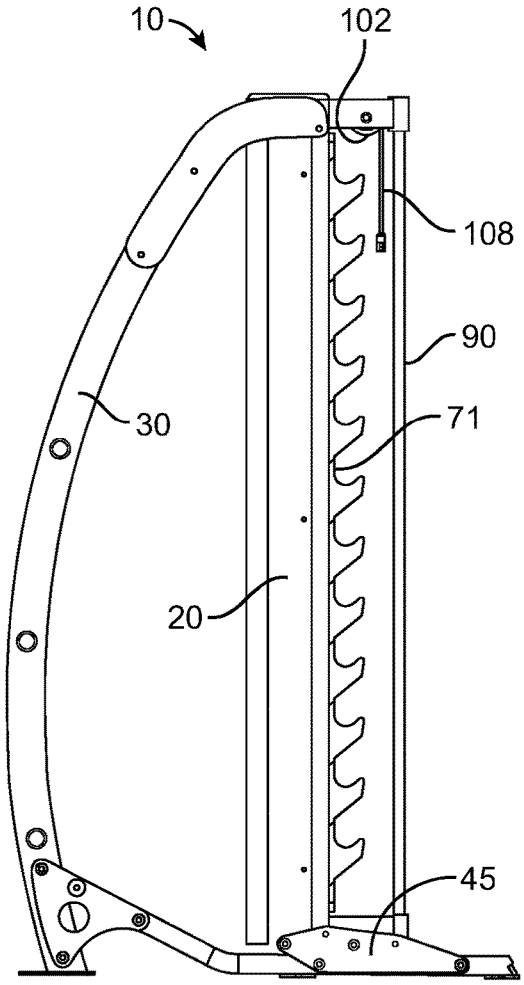
Figure 13:
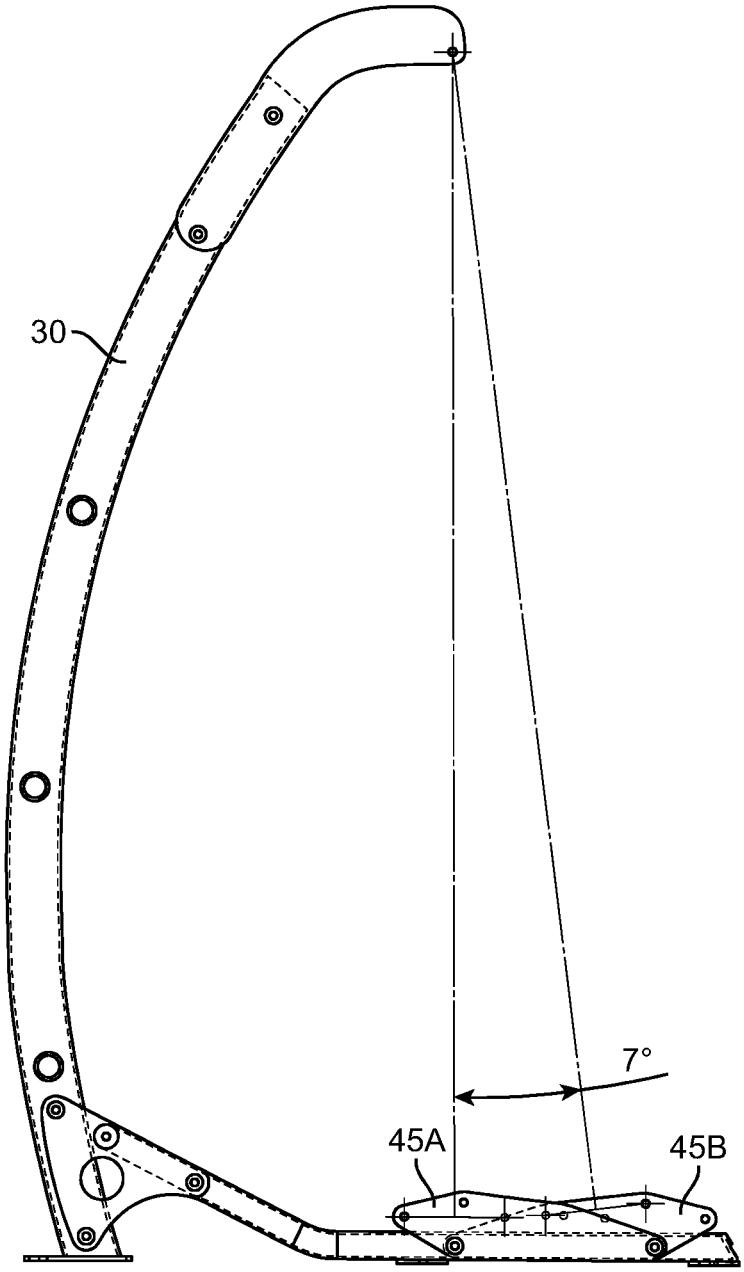
FIG. 13 is a side elevation view of the embodiments of FIGS. 12A and 12B with various components removed showing the different lifting angles achieved by placement of the bottom support brackets.

FIGS. 12A and 12B show alternate lifting angles achieved by the placement of a second embodiment of the bottom support brackets 45. FIG. 13 is a side elevation view of the embodiments of FIGS. 12A and 12B with various components removed showing the different lifting angles achieved by placement of the bottom support brackets 45A or 45B.

What is claimed is:

1. A Smith Machine, comprising:

(a) a pair of upright assemblies;

(b) a pair of support assemblies, wherein each support assembly is connected to one of the pair of upright assemblies;

(c) a pair of reversible bottom support brackets wherein each reversible bottom support bracket connects one of the upright assemblies to one of the support assemblies, and wherein each reversible support bracket can be mounted in a first position such that the upright assembly is in a first upwardly extending orientation or in a second position such that the upright assembly is in a second upwardly extending orientation, and wherein the first upwardly extending orientation is disposed at an angle to the second upwardly extending orientation, and wherein the upright assemblies can each be mounted in a forward facing orientation or in a backward facing orientation; and (d) a lift bar spanning between the pair of upright assemblies.

2. The Smith Machine of claim 1, further comprising:

(e) a top assembly holding the upright assemblies in vertically extending positions parallel to one another.

3. The Smith Machine of claim 2, wherein the top assembly connects upper portions of the upright assemblies or upper portions of the support assemblies together.

4. The Smith Machine of claim 1, wherein the first upwardly extending orientation is 90 degrees to a floor surface.

5. A Smith Machine, comprising:

(a) a pair of upright assemblies;

(b) a pair of support assemblies, wherein each support assembly is connected to one of the pair of upright assemblies;

(c) a pair of reversible bottom support brackets wherein each reversible bottom support bracket connects one of the upright assemblies to one of the support assemblies, and wherein each reversible support bracket can be mounted in a first position such that the upright assembly is in a first upwardly extending orientation or in a second position such that the upright assembly is in a second upwardly extending orientation, and wherein the upright assemblies can each be mounted in a forward facing orientation or in a backward facing orientation; and (d) a lift bar spanning between the pair of upright assemblies, wherein the second upwardly extending orientation is from 80 to 85 degrees to a floor surface.

6. The Smith Machine of claim 5, wherein the orientation is 83 degrees to a floor surface.

7. The Smith Machine of claim 1, wherein the bottom support brackets are generally L-shaped.

8. A Smith Machine, comprising:

(a) a pair of upright assemblies;

(b) a pair of support assemblies, wherein each support assembly is connected to one of the pair of upright assemblies;

(c) a pair of reversible bottom support brackets wherein each reversible bottom support bracket connects one of the upright assemblies to one of the support assemblies, and wherein each reversible support bracket can be mounted in a first position such that the upright assembly is in a first upwardly extending orientation or in a second position such that the upright assembly is in a second upwardly extending orientation, and wherein the upright assemblies can each be mounted in a forward facing orientation or in a backward facing orientation; and (d) a lift bar spanning between the pair of upright assemblies, wherein each upright assembly comprises:

a lever rest mount having a series of lever rest racking positions, a barbell slide pole positioned parallel to and spaced apart from the lever rest mount, a slider on the barbell slide pole, the slider supporting one of the ends of a barbell, and a locking lever dimensioned to be received into any one of the series of lever rest positions on the lever rest mount, wherein rotation of the barbell rotates the locking lever into one of the series of lever rest racking position, and a counterweight system that provides an upward force on the slider on the barbell slide pole.

9. The Smith Machine of claim 8, wherein the counterweight system comprises:

a pair of pulleys, a weight, and a cable passing over the pair of pulleys, the cable being connected to the weight and to the slider.

10. The Smith Machine of claim 9, wherein the pulleys, weight and cable are all disposed within the upright assembly.

11. The Smith Machine of claim 8, further comprising:

a slider stop at the bottom of the barbell slide pole for stopping downward motion of the slider.

* * * * *